US009516924B2

(12) United States Patent
Berns et al.

(10) Patent No.: US 9,516,924 B2
(45) Date of Patent: Dec. 13, 2016

(54) FASTENING ARRANGEMENT WITH INTERLOCKING MEMBERS

(71) Applicant: Under Armour, Inc., Baltimore, MD (US)

(72) Inventors: Jason Berns, Crofton, MD (US); F. Grant Kovach, Baltimore, MD (US); Alan Guyan, Baltimore, MD (US); Mari Lucero, Baltimore, MD (US); Kevin Patrick Fallon, Baltimore, MD (US); Kirsten Climer, Brooklyn, NY (US); Tara Machionna, New York, NY (US); Yvonne Lin, New York City, NY (US); Tucker Fort, Brooklyn, NY (US)

(73) Assignee: Under Armour, Inc., Baltimore, MD (US)

( * ) Notice: Subject to any disclaimer, the term of this patent is extended or adjusted under 35 U.S.C. 154(b) by 235 days.

(21) Appl. No.: 14/456,622

(22) Filed: Aug. 11, 2014

(65) Prior Publication Data

US 2014/0345095 A1 Nov. 27, 2014

Related U.S. Application Data

(63) Continuation of application No. 13/155,513, filed on Jun. 8, 2011, now Pat. No. 8,800,121.

(51) Int. Cl.

| | |
|---|---|
| ***A44B 11/26*** | (2006.01) |
| *A41F 1/00* | (2006.01) |
| *A44B 11/25* | (2006.01) |

(52) U.S. Cl.

CPC ..... *A44B 11/263* (2013.01); *A44B 11/2592* (2013.01); *A41F 1/008* (2013.01);

(Continued)

(58) Field of Classification Search

CPC ..... A44B 11/263; A44B 11/2592; A44B 11/2561; A44B 18/00; A44B 13/0023; A44B 13/0052; A41F 1/008; Y10T 24/25602; Y10T 24/45623; Y10T 24/2767; Y10T 24/45529; Y10T 24/45246

(Continued)

(56) References Cited

U.S. PATENT DOCUMENTS

| | | | |
|---|---|---|---|
| 1,073,714 | A | 9/1913 | Shorten |
| 3,913,187 | A | 10/1975 | Okuda |

(Continued)

*Primary Examiner* — Abigail Morrell

(74) *Attorney, Agent, or Firm* — Maginot, Moore & Beck LLP

(57) ABSTRACT

A fastening arrangement comprises a first fastening member connected to a first strap and a second fastening member connected to a second strap. The first fastening member includes a first surface comprising at least one first interlocking member. The second fastening member includes a channel positioned between a second surface and a biasing member. The channel is configured to receive the first fastening member with the first surface facing the second surface. The second surface includes at least one second interlocking member configured to engage the first interlocking member in a manner that blocks the first interlocking member from moving relative to the second interlocking member in at least one direction. The biasing member is configured to urge the first interlocking member into engagement with the second interlocking member when the first fastening member is inserted into the channel of the second fastening member.

19 Claims, 13 Drawing Sheets

(52) U.S. Cl.
CPC ..... *A44B 11/2561* (2013.01); *A44D 2200/10* (2013.01); *A44D 2200/12* (2013.01); *Y10T 24/2767* (2015.01); *Y10T 24/45246* (2015.01); *Y10T 24/45529* (2015.01); *Y10T 24/45602* (2015.01); *Y10T 24/45623* (2015.01); *Y10T 29/49908* (2015.01)

(58) Field of Classification Search
USPC ..... 24/16 PB
See application file for complete search history.

(56) References Cited

U.S. PATENT DOCUMENTS

| | | | |
|---|---|---|---|
| 4,183,120 | A | 1/1980 | Thorne |
| 4,393,548 | A | 7/1983 | Herb |
| 4,557,024 | A | 12/1985 | Roberts et al. |
| 4,727,630 | A | 3/1988 | Alan |
| 4,935,992 | A | 6/1990 | Due |
| 4,961,251 | A | 10/1990 | Smith |
| 5,148,576 | A | 9/1992 | Dyer |
| 5,208,952 | A | 5/1993 | Mintel et al. |
| 5,423,501 | A | 6/1995 | Yu |
| 5,474,268 | A | 12/1995 | Yu |
| 5,678,281 | A | 10/1997 | Kamp et al. |
| 5,752,298 | A | 5/1998 | Howell |
| 5,826,308 | A | 10/1998 | Chang |
| D418,725 | S | 1/2000 | Evans |
| D420,569 | S | 2/2000 | Evans |
| 6,219,889 | B1 | 4/2001 | Lovato et al. |
| 6,457,210 | B1 | 10/2002 | Shirai et al. |
| 6,463,637 | B1 | 10/2002 | Carnahan |
| 6,467,136 | B1 | 10/2002 | Graham |
| 6,487,759 | B1 | 12/2002 | Akeno et al. |
| 6,647,750 | B2 | 11/2003 | Kaneko et al. |
| 7,478,460 | B2 | 1/2009 | Gallant et al. |

FASTENING ARRANGEMENT WITH INTERLOCKING MEMBERS

CROSS-REFERENCE TO RELATED APPLICATIONS

This application is a continuation of U.S. patent application Ser. No. 13/155,513, filed Jun. 8, 2011, now U.S. Pat. No. 8,800,121.

FIELD

This application relates to the field of closures and other fastening arrangements for releasably coupling two components on a garment, bag, shoe, watch, or other accessory.

BACKGROUND

Various fastening arrangements are known in the art for releasably coupling two components such as the ends of two straps. Typical fastening arrangements are comprised of hard plastic materials. While these conventional fastening arrangements are capable of withstanding a strong tensile force, they are generally rigid and non-flexible. Accordingly, these conventional fastening arrangements do not adapt to the contours of a body and can cause irritation when in contact with the skin.

In addition to the above, the fastening members of conventional fastening arrangements are not adjustable. While the components coupled to the fastening members are sometimes adjustable (e.g., adjustable straps), the fastening arrangement itself typically does not offer the user the ability to easily make minor adjustments to the fastening arrangement.

Furthermore, conventional fastening arrangements can be difficult to close. In particular, conventional fastening arrangements often include small parts that must be properly manipulated in order to close or release the fastening arrangement. If the fastening arrangement is out of sight, such as when the fastening arrangement is provided on a bra or other garment where the fastening arrangement is behind the body, it is often difficult for the user to easily engage and disengage the small components of the arrangement. Also, if the user has limited dexterity, it may be difficult for the user to easily engage and disengage the small components of conventional fastening arrangements even if the components are in plain sight to the user.

In view of the foregoing, it would be desirable to provide a fastening arrangement that is more comfortable when in contact with human skin. It would also be desirable to provide an adjustable fastening arrangement. Furthermore, it would be advantageous to provide a fastening arrangement that is more easily opened and closed, even when the fastening arrangement is out of sight of the user.

SUMMARY

In accordance with one embodiment of the disclosure, there is provided a fastening arrangement comprising a first fastening member connected to a first strap and a second fastening member connected to a second strap. The first fastening member includes a first surface comprising at least one first interlocking member. The second fastening member includes a channel positioned between a second surface and a biasing member. The channel is configured to receive the first fastening member with the first surface facing the second surface. The second surface includes at least one second interlocking member configured to engage the first interlocking member in a manner that blocks the first interlocking member from moving relative to the second interlocking member in at least one direction. The biasing member is configured to urge the first interlocking member into engagement with the second interlocking member when the first fastening member is inserted into the channel of the second fastening member.

Pursuant to another embodiment of the disclosure, there is provided a fastening arrangement comprising a first fastening member and a second fastening member. The first fastening member includes a first surface comprising an array of first interlocking members. The second fastening member includes a channel configured to releasably receive the first fastening member. The channel is defined at least in part by a second surface comprised of a resilient material. The second surface includes an array of second interlocking members configured to engage the first interlocking members in a manner that blocks the first fastening member from moving relative to the second fastening member in a first direction in the channel, but allows the first fastening member to move relative to the second fastening member in the channel in a second direction that is opposite the first direction. The second surface is configured to deform when a release force is applied to the second fastening member. The release force causes the second interlocking members to be removed from the first interlocking members such that the first fastening member is not blocked from moving relative to the second fastening member in the first direction.

In accordance with yet another embodiment of the disclosure, there is provided a method of coupling and releasing two members of a fastening arrangement. The method includes inserting a first fastening member into a channel of a second fastening member in an insertion direction. The method also includes urging an array of first interlocking members on a first surface of the first fastening member into engagement with an array of second fastening members on a second surface within the channel of the second fastening member, and sliding the array of first interlocking members over the array of second interlocking members as the first fastening member is moved further into the channel in the insertion direction. In addition, the method includes abutting the first interlocking members with the second interlocking members within the channel such that the first fastening member is blocked from moving relative to the second fastening member in a removal direction that is opposite the insertion direction. Finally, the method includes deforming the second surface such that the second interlocking members are removed from the first interlocking members, and releasing the first fastening member from the second fastening member by moving the first fastening member out of the channel in the removal direction.

The above described features and advantages, as well as others, will become more readily apparent to those of ordinary skill in the art by reference to the following detailed description and accompanying drawings. While it would be desirable to produce a fastening arrangement that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
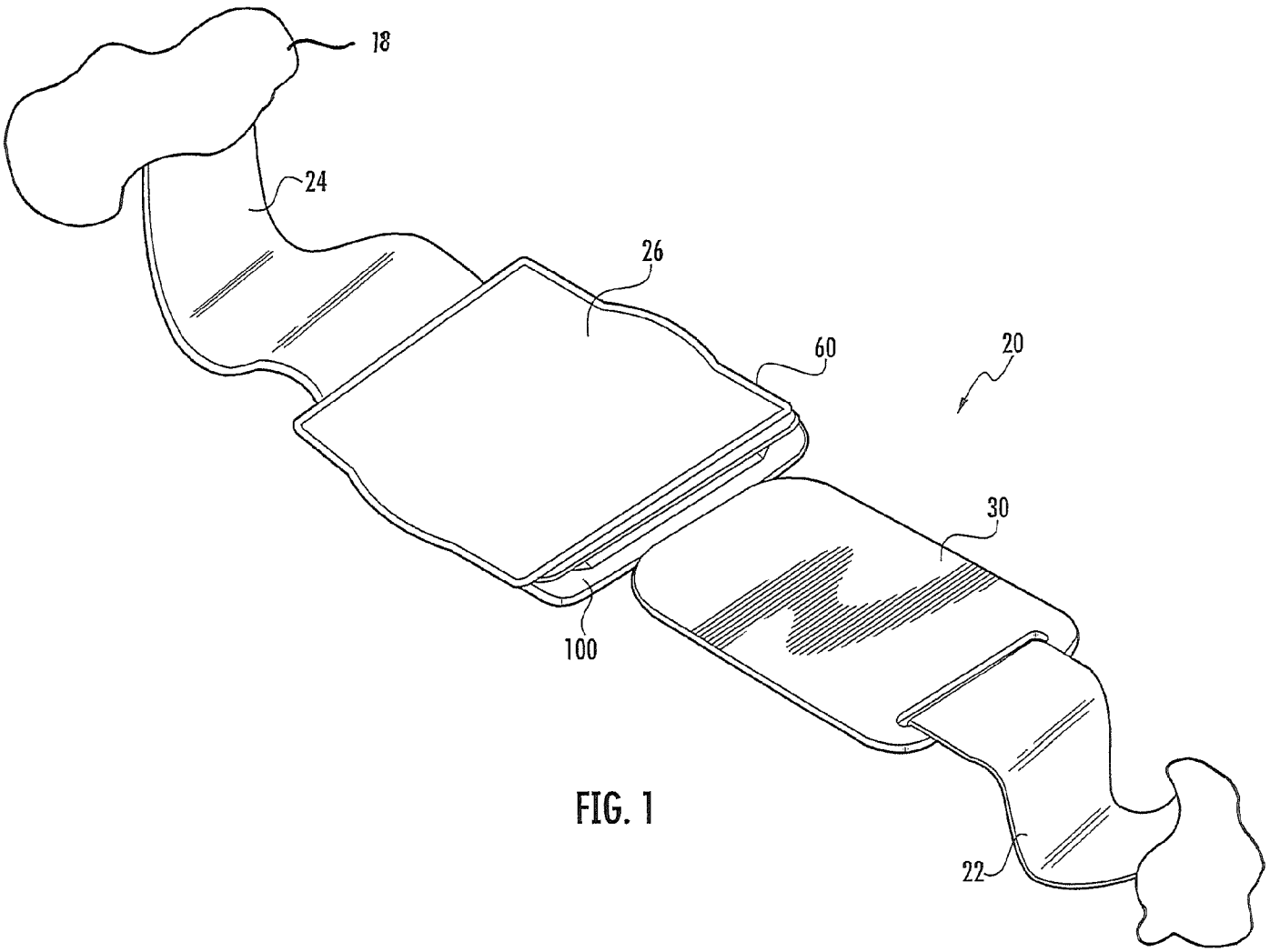
FIG. 1 shows a perspective view of a fastening arrangement including a first fastening member coupled to a first strap and a second fastening member encased in a fabric covering and coupled to a second strap.

With reference now to FIG. 1, a fastening arrangement 20 includes a first fastening member 30 configured to be releasably coupled to a second fastening member 60. The first fastening member 30 is connected to an end of a first strap 22 and the second fastening member 60 is connected to the end of a second strap 24. As explained in further detail below, the first fastening member 30 and the second fastening member 60 include complimentary surface features that may be engaged to cause the two fastening members 30, 60 to be coupled to one another, thus allowing the first strap 22 to be coupled to the second strap 24. A release mechanism on the second fastening member causes the surface features of the second fastening member 60 to be removed from the surface features on the first fastening member 30 such that the two fastening members 30, 60 and the associated straps 22, 24 may be released from one another. The first fastening member may be partially or completely encased in a fabric cover 26.

With continued reference to FIG. 1, the straps 22, 24 may be any of various types of straps as are commonly used on an accessory 18, which accessory may take any of various forms including garments, bags, belts, shoes, pads, gloves, watches, or other accessories. In at least one embodiment, the straps 22, 24 may be comprised of an elastomeric material or include elastic fibers that provide a resilient stretch capability to the straps 22, 24. In other embodiments, one or more of the straps 22, 24 may be comprised of a relatively strong and non-elastic material that does not generally stretch. The straps 22, 24 may be connected to the first fastening member 30 and the second fastening member 60 in any of various manners, such as looping the ends of the straps 22, 24 through a slot on the fastening member 30, 60, or molding the fastening members 30, 60 directly onto the ends of the straps 22, 24, as explained in further detail below.

Figure 2:
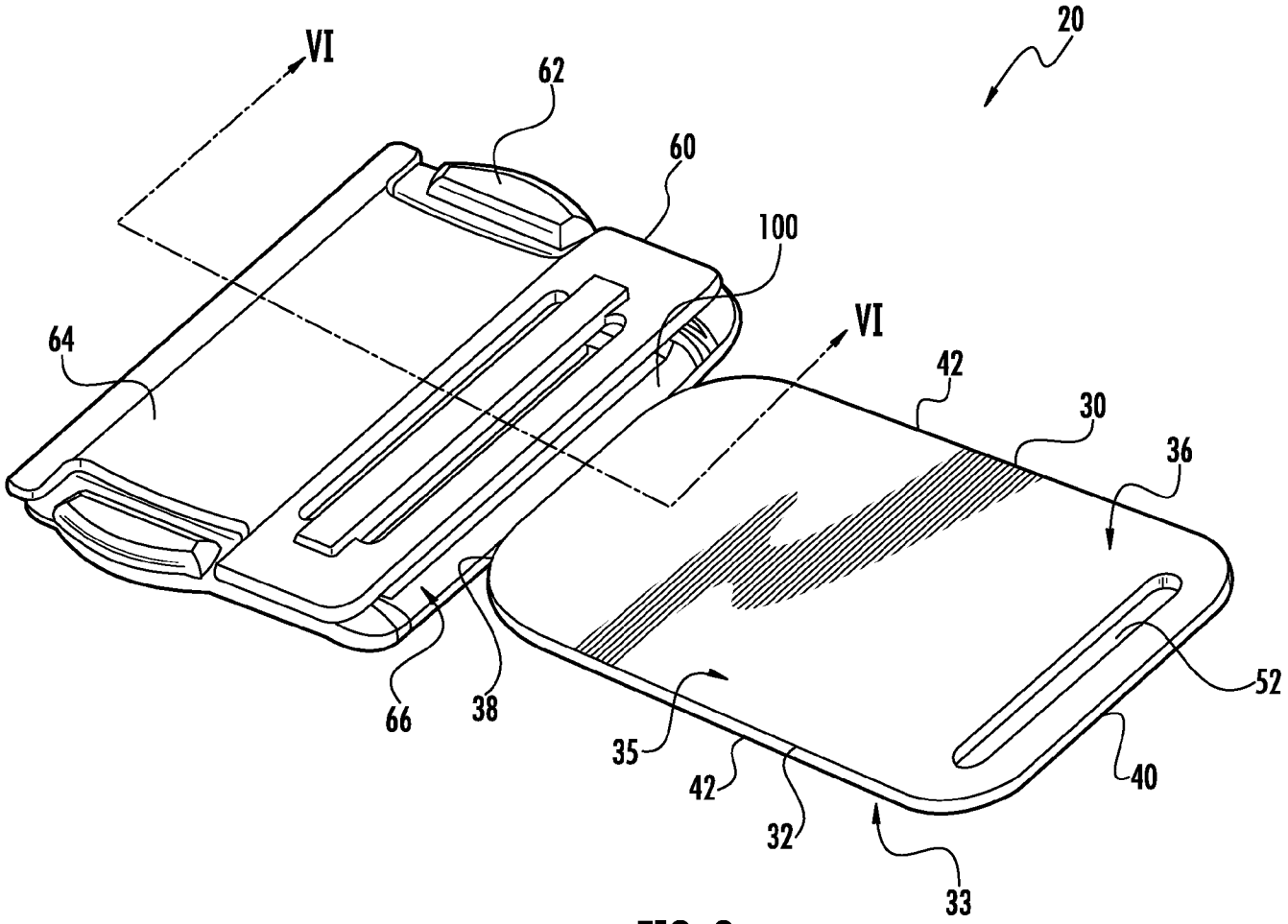
FIG. 2 shows a perspective view of the fastening arrangement of FIG. 1 with the fabric covering removed from the second fastening arrangement.
Figure 3:
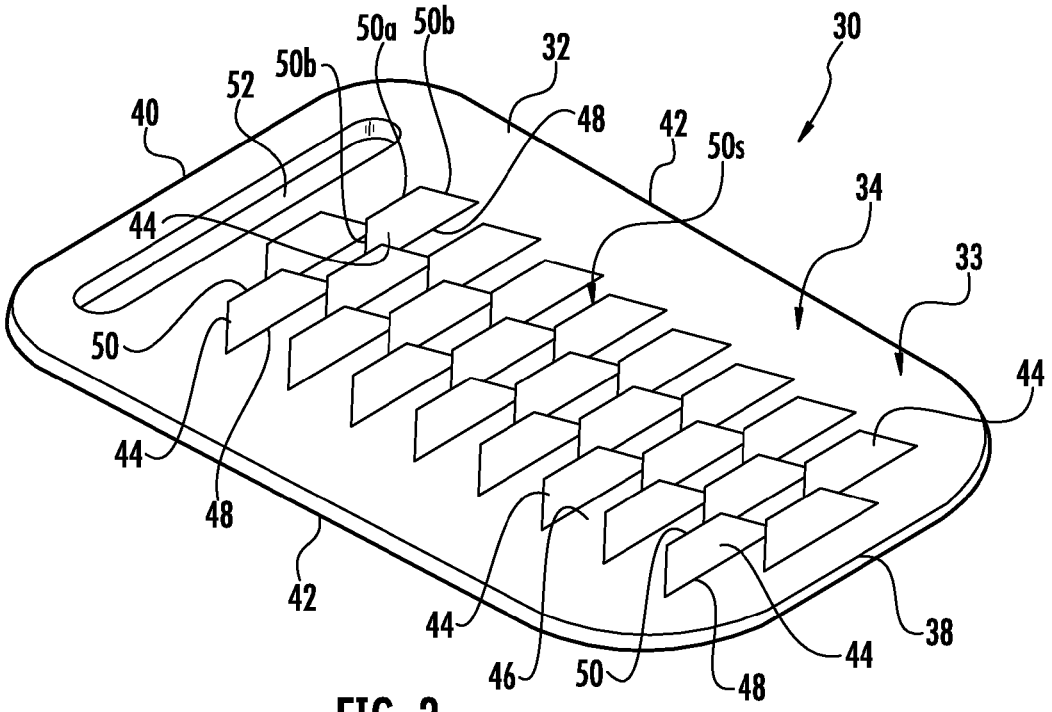
FIG. 3 shows a perspective view of a plate of the first fastening arrangement of FIG. 2.

With reference to FIGS. 2 and 3, the first fastening member 30 is provided in the form of a plate 32 including a first face 33 and an opposing second face 35. A contoured surface 34 is provided on the first face 33 and a substantially flat surface 36 is provided on the opposite second face 35. The plate 32 is substantially trapezoidal or rectangular in shape and includes a leading edge 38 and a trailing edge 40 with sides 42 extending between the leading edge 38 and the trailing edge 40. The sides 42 may be slightly angled such that the plate 32 is slightly wider at the trailing edge 40 than the leading edge 38. An elongated slot 52 is provided in the plate 32 near the trailing edge 40.

As best shown in FIG. 3, the contoured surface 34 on the first face 33 includes a flat portion 46 and an array of interlocking members in the form of teeth 44 (which may also be referred to herein as "scales"). The teeth 44 are wedge-shaped and ramp-like in structure with each tooth including a leading edge 48 that is flush with the flat portion 46 and a trailing edge 50 that is elevated from the flat portion 46. Each tooth 44 is gradually elevated (i.e., ramps further away from the flat portion 46) starting at the leading edge 48 and ending at the trailing edge 50. Accordingly a rear shoulder 50*s* is formed on each tooth 44 between the trailing edge 50 of the tooth 44 and the flat portion 46. The leading edge 48 of each tooth 44 is parallel to the leading edge 38 and the trailing edge 40 of the plate 32. The trailing edge 50 also includes a portion 50*a* that is parallel to the leading edge 38 and the trailing edge 40 of the plate 32, but also includes two portions 50*b* that are non parallel to the leading edge 38, trailing edge 40, or each other. Accordingly, as can be seen in FIG. 3, each tooth 44 has a trapezoidal footprint. As explained in further detail below, the teeth 44 serve as interlocking members that engage other interlocking members on the second fastening member 60. While the embodiment of FIG. 3 only includes teeth 44 on the first face 33, it will be appreciated that in other embodiments the opposite face 35 may also include a contoured surface with teeth.

In the embodiment disclosed herein, the plate is generally about 40-60 mm long, about 20 mm wide, and about 1 mm thick (from the flat portion 46 of the first face 33 to the flat surface 36 of the second face 35). The trailing edge 50 of each tooth 44 is generally elevated from the flat portion 46 of the first face 33 by about 1 mm or less. Thus, the teeth 44 do not appear as large protrusions on the contoured surface 34, and instead appear as mere scales, bumps or other surface irregularities on the contoured surface 34. This appearance of small surface irregularities is furthered by the relatively large surface area provided by the contoured surface 34. For example, the contoured surface 34 may be a rectangular surface of about 50 mm by 20 mm (i.e., 1000 $mm^2$) while the teeth 44 extend only about 1 mm from the flat portion 46 of the contoured surface 34. As used herein, a contoured surface comprised of a flat portion with surface irregularities may still be considered "substantially planar" if the surface irregularities (e.g., 44) protrude from the flat portion (e.g., 46) by a distance that is less than 5% of the square root of the area covered by the contoured surface 34 of the plate 32 (e.g., in the example above, $1<(0.05)\sqrt{1000}$).

The slot 52 facilitates connection of the first fastening member 30 to the end of the first strap 22. In particular, the first strap 22 may be threaded through the slot 52 and a buckle or other joining means may be used to form a loop in the strap that retains the plate 32. In other alternative embodiments, the first strap 22 may be secured to the plate 32 without the need for the slot 52. For example, in at least one alternative embodiment, the plate 32 may be molded onto the end of the strap 22. In such an embodiment, the end of the first strap 22 may be positioned within a mold and the resin material that will form the plate 32 may be injected into the mold such that it flows around and through the strap 22. When the resin material in the mold cures, the first strap 22 is non-releasably joined to the plate 32.

The first fastening member 30 is generally comprised of a soft polymer material such as, for example, polyethylene, polyester, polypropylene, or polyurethane, nylon, polyoxymethylene, high density polyethylene, or other soft polymers. The soft polymer material makes the plate 32 resilient, allowing the plate 32 to bend and conform to a body which the plate 32 may rest against.

With reference now to FIGS. 2 and 4-6, the second fastening member 60 includes a deformable component 62 and a biasing member 64 with a channel 66 formed between the deformable component 62 and the biasing member 64. Similar to the plate 32 of the first fastening member 30, the deformable component 62 and the biasing member 64 of the second fastening member 60 may also be comprised of a resilient soft polymer material such as, for example, polyethylene, polyester, polypropylene, polyurethane, nylon, polyoxymethylene, high density polyethylene, or other soft polymers.

Figure 4:
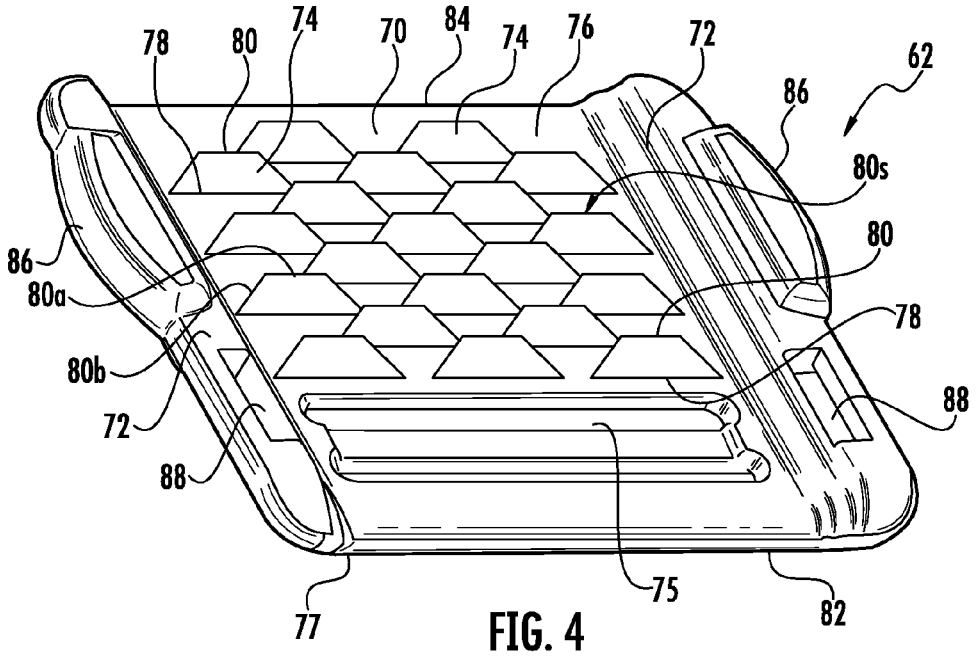
FIG. 4 shows a perspective view of a deformable component of the second fastening member of FIG. 2.

As best shown in FIG. 4, the deformable component 62 is generally rectangular in shape and includes a contoured interior surface 70 that is slightly recessed between two opposing side rails 72. The contoured surface 70 includes a flat portion 76, an array of interlocking members in the form of teeth 74 (which may also be referred to herein as "scales"), and slots 75 on a forward end of the contoured surface 70. The forward edge 77 of the contoured interior surface 70 is slightly flared and serves as a lip of the mouth 100 of the channel 66.

Figure 6:
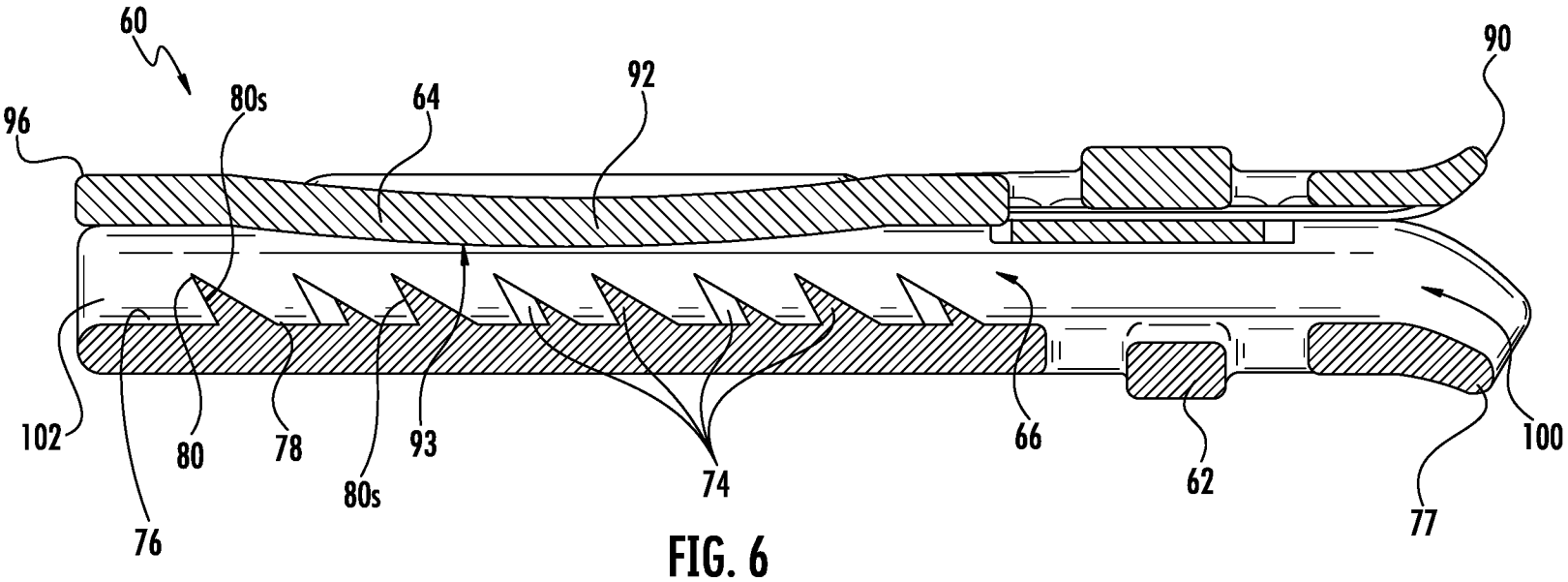
FIG. 6 shows a cross-sectional view of the second fastening member along line VI-VI of FIG. 2.

The teeth 74 extend outward from the flat portion 76 and are complimentary to the teeth 44 on the first fastening member 30. Accordingly, the teeth 74 are also wedge-shaped and ramp-like in structure with each tooth 74 including a front side 78 that is flush with the flat portion 76 of the contoured surface 70 and a rear side 80 that is elevated from the flat portion 76. Each tooth 74 is gradually elevated outward from the flat portion 76 starting at the front side 78 and ending at the rear side 80. Accordingly a shoulder 80*a* is formed on each tooth 74 between the rear side 80 of the tooth 74 and the flat portion 76. As best seen in FIG. 6, an acute angle is formed by the shoulder 80*a* at the rear side of the tooth.

With continued reference to FIG. 4, the front side 78 of each tooth 74 is parallel to a front edge 82 and a rear edge 84 of the contoured interior surface 70 of the deformable component 62. Similar to the teeth 44 of the first fastening member 30, the teeth 74 have a trapezoidal footprint. Accordingly, the rear side 80 of each tooth 74 includes a first portion 80*a* that is parallel to the front edge 82 and a rear edge 84 of the contoured interior surface 70, and two second portions 80*b* that are not parallel to the front edge 82 and rear edge 84 of the contoured interior surface 70. Additionally, the front side 78 of each tooth 74 is wider than the first portion 80*a* of the rear side 80. As explained in further detail below, the teeth 74 on the second fastening member 60 serve as interlocking members that engage other the teeth 44 on the first fastening member 30.

The opposing side rails 72 of the deformable component 62 are integral with the contoured interior surface 70 and flare slightly outward from the contoured interior surface 70. Each opposing side rail 72 includes a finger pad 86 and a coupling slot 88. Each finger pad 86 is bowed slightly outward on the associated side rail 72, providing a convex side surface that is designed and dimensioned to easily engage a human fingertip. The coupling slots 88 are configured to receive coupling tabs 98 on the biasing member, as explained in further detail below.

Figure 5:
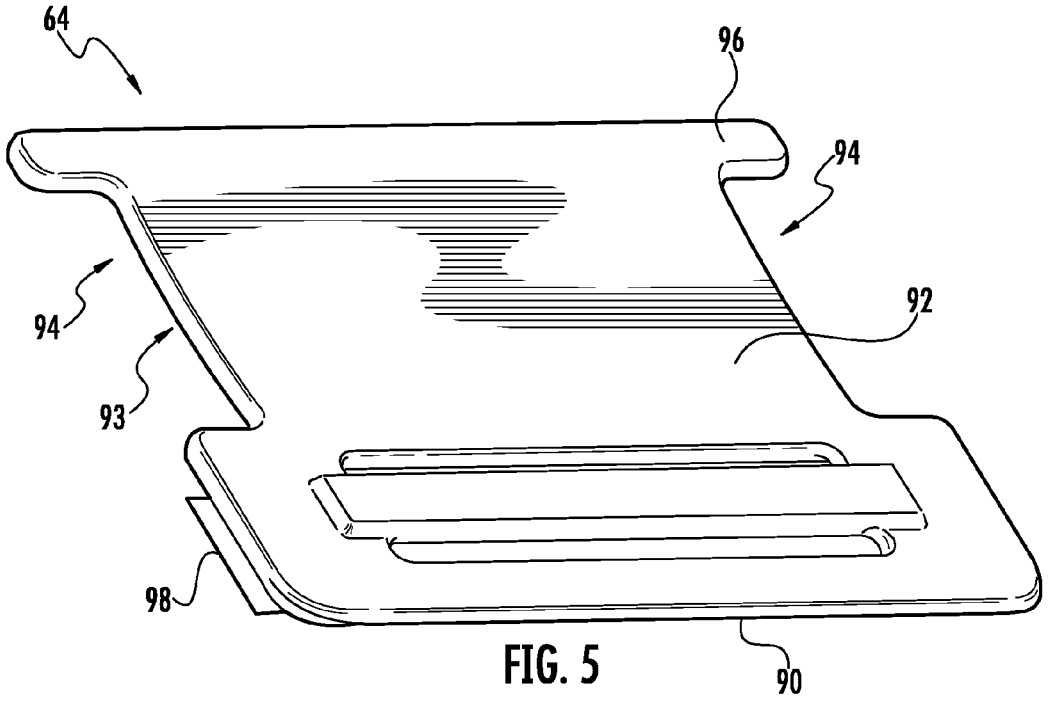
FIG. 5 shows a perspective view of a biasing member of the second fastening member of FIG. 2.

With reference now to FIG. 5, the biasing member 64 is generally I-shaped and includes a forward edge 90, a central bowed portion 92, central recesses 94, a rear support 96, and two coupling tabs 98. The forward edge 90 is slightly flared and serves as a lip for the mouth 100 of the channel 66. The central bowed portion 92 extends between the forward edge 90 and the rear support 96. The central bowed portion 92 is generally rectangular in shape but is slightly curved such that a convex surface 93 is provided on one side of the bowed portion that extends between the forward edge 90 and the rear support 96. The central recesses 94 extend along the opposing sides of the central bowed portion 94. Each central recess 94 is designed and dimensioned such that one of the finger pads 86 of the deformable component 62 can fit within the central recess 94. The coupling tabs 98 are provided on opposite sides near the forward edge 90 of the biasing member 64. The coupling tabs 98 extend outward and away from the rear support forward edge 90 and are configured to tightly fit into the coupling slots 88 of deformable component 62 and therefore fasten the biasing member 64 to the deformable component 62, as shown in FIG. 2.

With reference now to FIG. 6, when the biasing member 64 is joined to the deformable component 62, a channel 66 is defined between the biasing member 64 and the deformable component 62. In particular, the channel 66 is formed by the contoured interior surface 70 of the deformable component 62, the side rails 72 of the deformable component 62, and the side of the biasing member 64 that includes the convex surface 93. A mouth 100 to the channel 66 is formed by the forward edge 77 of the deformable component 62 and the forward edge 90 of the biasing member 64, with the forward edge 77 and forward edge 90 providing flared lips for the mouth 100. The height of the channel 66 is reduced near the middle of the channel as a result of the convex surface 93 of the biasing member 64. An exit 102 from the channel 66 is also provided via an opening at the rear of the second fastening member 60. The teeth 74 of the deformable component 62 extend inward toward the channel 66 and are inclined from the forward end (i.e. mouth 100) toward the rear end (i.e., exit 102) of the channel 66. Accordingly, the front side 78 of each tooth 74 is closer to the mouth 100 than the rear side 80. At the same time, the rear side 80 of each tooth 74 is more elevated on the contoured interior surface 70 (i.e., positioned further from the flat portion 76) than the front side 78 of the tooth 74.

With reference again to FIG. 1, a fabric cover 26 may be used to partly or completely encase the second fastening member 60, leaving mouth 100 open to receive the first fastening member 30. The fabric cover is typically comprised of a cotton, nylon or polyester material, or some combination thereof, which provides a soft comfortable feel to a wearer when the fabric cover 26 is in contact with the wearer's skin. The fabric cover 26 may have an elastic component (e.g., elastane fibers) that causes the fabric cover 26 to tightly adhere to the second fastening member 60. This elastic component not only keeps the fabric cover 26 in place on the second fastening member 60, but also allows the user to easily locate various features of the second fastening member, and particularly the finger pads 86 on the sides of the second fastening member 60. While the fabric cover 26 in FIG. 1 does not extend over the mouth 100 of the second fastening member 60, in other embodiments, the fabric cover 26 could extend over the mouth 100 in order to completely enclose the second fastening member 60.

Figure 7:
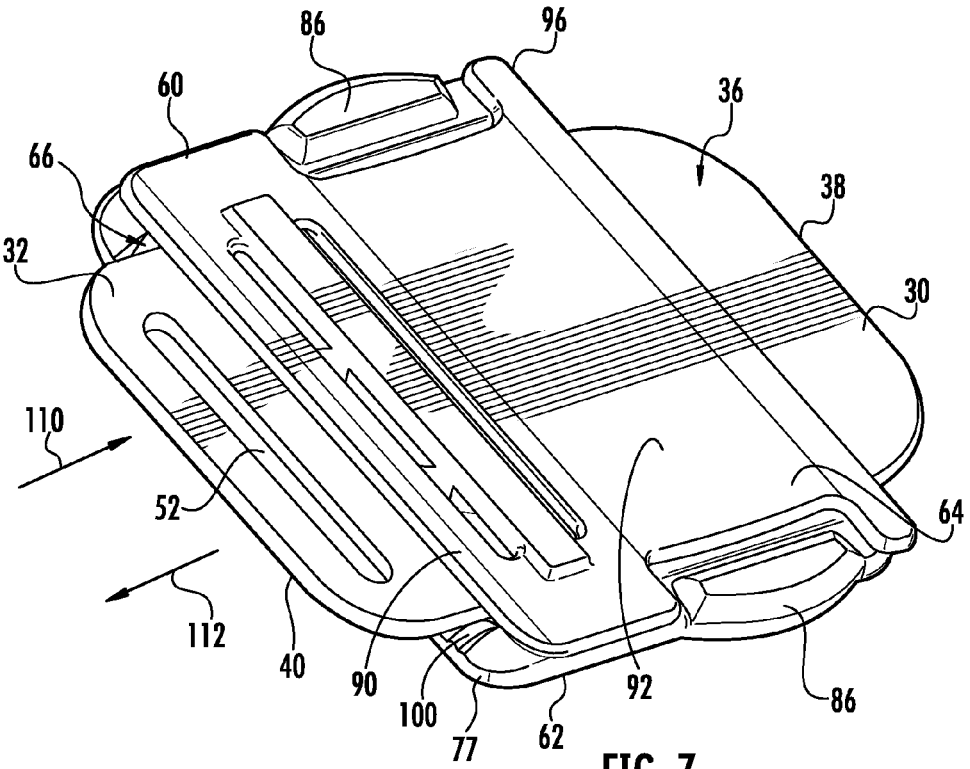
FIG. 7 shows a perspective view of the first fastening member inserted into a channel of the second fastening member in the fastening arrangement of FIG. 2.

In operation, a user can couple the first fastening member 30 to the second fastening member 60 by inserting the plate 32 into the channel 66 with the teeth 44 on the plate 32 facing the teeth 74 on the deformable component 62. As shown in FIG. 7, the plate 32 is inserted into the channel 66 in an insertion direction 110. As the user inserts the plate 32 into the channel 66 in the insertion direction 110, the angled teeth 44 on the plate successively slide over the angled teeth 74 on the deformable component 62. As the plate 32 is passed further into the channel 66, it engages and deflects the central bowed portion 92 of the biasing member 64, which acts as a leaf spring within the channel 66. In particular, because the biasing member 64 is comprised of a resilient material, it resists deformation and provides a counter force on the plate 32, urging the contoured surface 34 of the plate 32 into closer engagement with the contoured interior surface 70 of the deformable component 62. When a tooth 44 on the first fastening member 30 slides over a complimentary tooth 74 on the second fastening member 60, the shoulder at the trailing edge 50 of the tooth 44 moves past the shoulder at the rear side 80 of the complimentary tooth 74, and the biasing member 64 forces the shoulders into locking engagement. This action also provides audible or tactile feedback to the user as the shoulders of the teeth 44, 74 snap past one another, letting the user know that the plate 32 is being properly inserted into the channel 66. With the shoulders of the teeth 44, 74 forced into engagement, any movement of the first fastening member 30 in a removal direction 112 causes the trailing edge 50 of the tooth 44 to abut the rear side 80 of an interlocking tooth 74, thus blocking the first fastening member 30 from moving in the removal direction 112 within the second fastening member 60. Additionally, because the biasing member 64 urges the plate 32 toward the deformable component 62, the first fastening member fits snugly within the channel 66 of the second fastening member, and therefore the shoulders of the teeth 44, 74 do not easily move out of the interlocking abutment.

Figure 8:
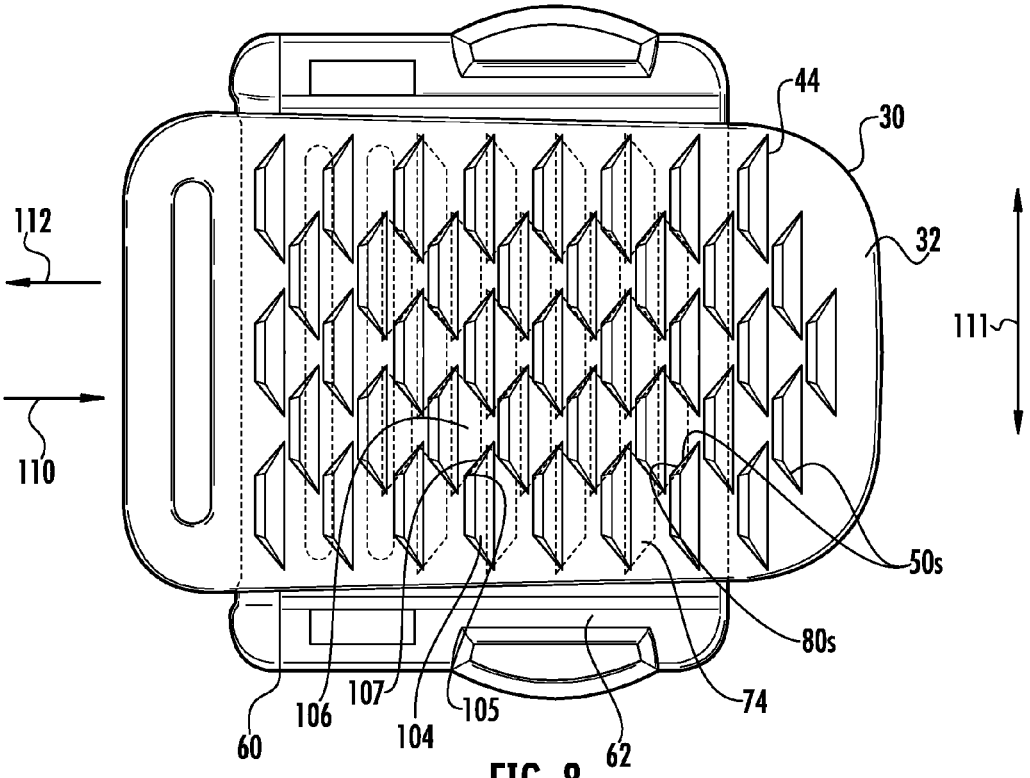
FIG. 8 shows an illustration of the engagement of teeth on the first fastening member with teeth on the second interlocking member in the fastening arrangement of FIG. 2.

FIG. 8 illustrates the interlocking engagement of the array of teeth 44 on the first fastening member 30 with the array of teeth 74 on the second interlocking member 60. In this illustration, the plate 32 is shown as generally transparent in order to show the teeth 44 on the plate 32 engaging the teeth 74 on the deformable component 62. As shown in FIG. 8, the teeth 44, 74 both have a substantially trapezoidal footprint. When moved into locking engagement, the array of teeth 44 on the first fastening member 30 engages the array of teeth 74 on the second fastening member 60 such that the shoulders 50*s*, 80*s* on the non-parallel sides of the trapezoidal teeth 44 and 74 are in abutment. For example, in FIG. 8 side 105 of tooth 104 on the first fastening member 30 abuts side 107 of tooth 106 on the second fastening member 60. This abutment between the two arrays of teeth 44 and 74 causes the perimeter of the teeth 44 and 74 to appear as an overlapping hexagon arrangement when the teeth are viewed from a plan view, such as that shown in FIG. 8. Additionally, because the abutment between the teeth 44 and 74 occurs along the non-parallel sides of the teeth (e.g., along sides 105 and 107 for teeth 104 and 106 of FIG. 8), the teeth are generally wedged together and prevented from shifting in a direction perpendicular to the insertion direction 110 (i.e., the teeth are prevented from shifting along line 111 in FIG. 8). This interlocking arrangement between the teeth 44, 74 provides a force component that prevents the first fastening member 30 from shifting relative to the second fastening member 60 along line 111 and keeps the teeth 44, 74 properly aligned when the first fastening member 30 is inserted into the second fastening member 60.

With reference again to FIG. 7, once the first fastening member 30 is inserted into the channel 66, the user may make successive fine adjustments to the extent the first fastening member 30 is inserted into the channel in the insertion direction 110. In particular, although the array of first interlocking teeth 44 engage the array of second interlocking teeth 74 and block the first fastening member 30 from movement in channel 66 in the removal direction 112, continued advancement of the first fastening member 30 in the insertion direction 110 remains possible. In fact, the exit 102 at the rear of the second fastening member 60 allows the leading edge 38 of the first fastening member 30 to be inserted completely through the channel 66 while the array of first interlocking teeth 44 remain engaged with the array of second interlocking teeth 74. Thus, a fine adjustment mechanism is provided by the fastening arrangement 20.

If the fastening arrangement 20 is used on a garment, such as on the straps of a bra, the fine adjustment mechanism allows for fine adjustments to the fit of the garment. In particular, when the first fastening member 30 is coupled to the second fastening member 60, the plate 32 may be inserted further into the channel 66, effectively shortening the length of the attached straps 22, 24, and providing a slightly tighter fit for the garment (e.g., the slot 52 of the plate 32 may be inserted all the way to the mouth 100 of the second fastening member 60, as shown in FIG. 7). Alternatively, the plate 32 may be inserted a relatively small extent into the channel 66, effectively increasing the length of the attached straps 22, 24, and providing a looser fit for the garment (e.g., the leading edge 38 of the plate 32 may be extended only to the finger pads 86 of the second fastening member 60). Accordingly, in addition to the ability to adjust the length of the straps of the garment with a traditional clasp or other buckle mechanism, the fastening arrangement 20 described herein also provides the user with the ability to make fine adjustments to the length of a strap without adjusting a clasp or other buckle mechanism.

Figure 9:
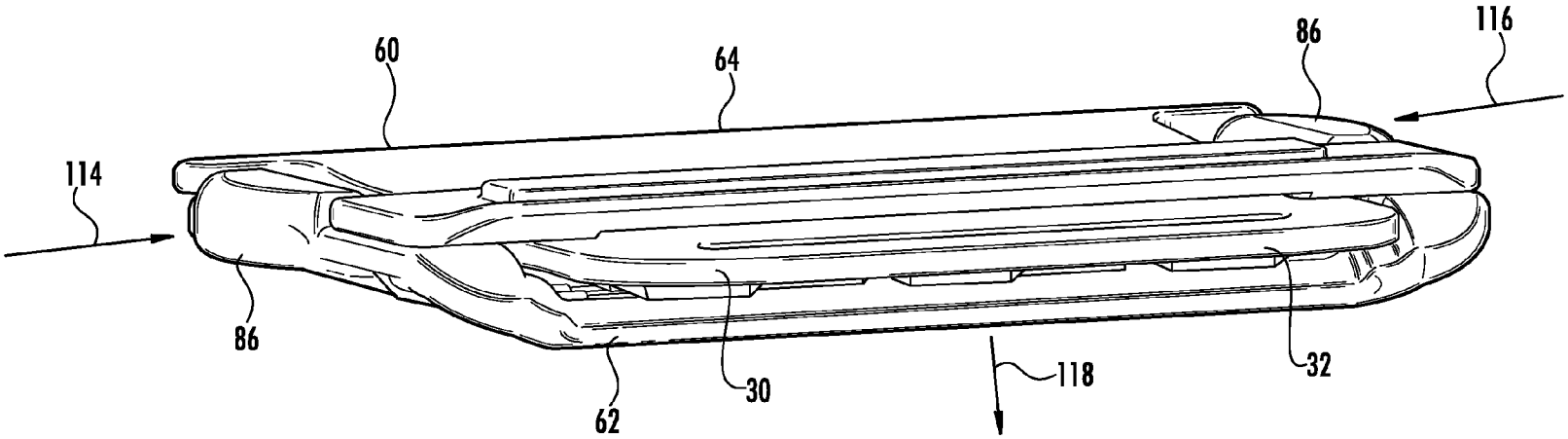
FIG. 9 shows a perspective view of the fastening arrangement of FIG. 2, illustrating where opposing forces are applied to the second fastening member.
Figure 10:
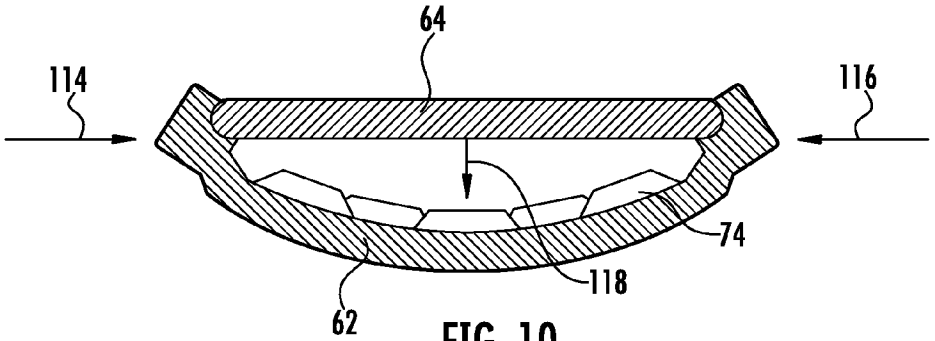
FIG. 10 shows and illustration of the opening of the mouth of the second fastening member of FIG. 2 when the opposing forces are applied to the second fastening member.

With reference now to FIGS. 9 and 10, when a user wishes to release the first fastening member from the channel 66 of the second fastening member 60, the user places his or her fingers on the finger pads 86 at the sides of the deformable component 62. The user then presses inward on the finger pads 86, providing opposing inward forces 114, 116 on the deformable component. Because the central recesses 94 of the biasing member 64 provide a small space between the deformable component 62 and the biasing member 64 at the finger pads 86, this action causes the finger pads 86 to be moved inward in the direction of arrows 114, 116 without significantly deforming the biasing member 64. These opposing inward forces 114, 116 result in deformation of the contoured interior surface 70 of the deformable component 62 in a release direction, indicated by arrow 118. In particular, the contoured interior surface 70 of the deformable component bows outward, away from the biasing member 64, in response to the opposing inward forces 114, 116 being applied to the finger pads 86.

Movement of the contoured interior surface 70 in the release direction 118 moves the teeth 74 of the second fastening member 60 away from the teeth 44 of the first fastening member 30, resulting in a more open mouth 100 on the second fastening member 60, as illustrated in FIG. 10. With the mouth 100 open, and the teeth 74 disengaged from the teeth 44, the first fastening member 30 may be easily pulled out of the channel 66 in a removal direction indicated by arrow 112. After the first fastening member 30 is removed from the second fastening member 60, the user releases his or her fingers from the finger pads 86, removing the opposing inward forces 114, 116 on the deformable component 62. Because the deformable component 62 is resilient, it then returns to its original non-deformed shape where the mouth 100 is less open than the mouth illustrated in FIG. 10.

As described above, the fastening arrangement 20 provides the user with a closure having components that are easy and convenient to engage and disengage. Because the components are comprised of a soft material, they are comfortable when in contact with the user's skin. Additionally, the fabric cover 26 on the second fastening member 60 provides further comfort for the user. Even with the fabric covering 26, the protruding finger pads 86 which provide a release mechanism for the fastening arrangement 20 are easy to find and manipulate. Additionally, because the first fastening member 30 is moveable to successive locking positions within the second fastening member 60, a fine adjustment mechanism is provided by the fastening arrangement 20.

With reference now to FIGS. 11-15 an alternative embodiment of a second fastening member 160 is shown. In this embodiment, the second fastening member 160 includes a deformable component 162 and a biasing member 164 with a channel 166 formed between the deformable component 162 and the biasing member 164. The deformable component 162 and the biasing member 164 of the second fastening member 160 may be comprised of a resilient soft polymer material such as, for example, polyethylene, polyester, polypropylene, polyurethane, nylon, polyoxymethylene, high density polyethylene, or other soft polymers.

Figure 12:
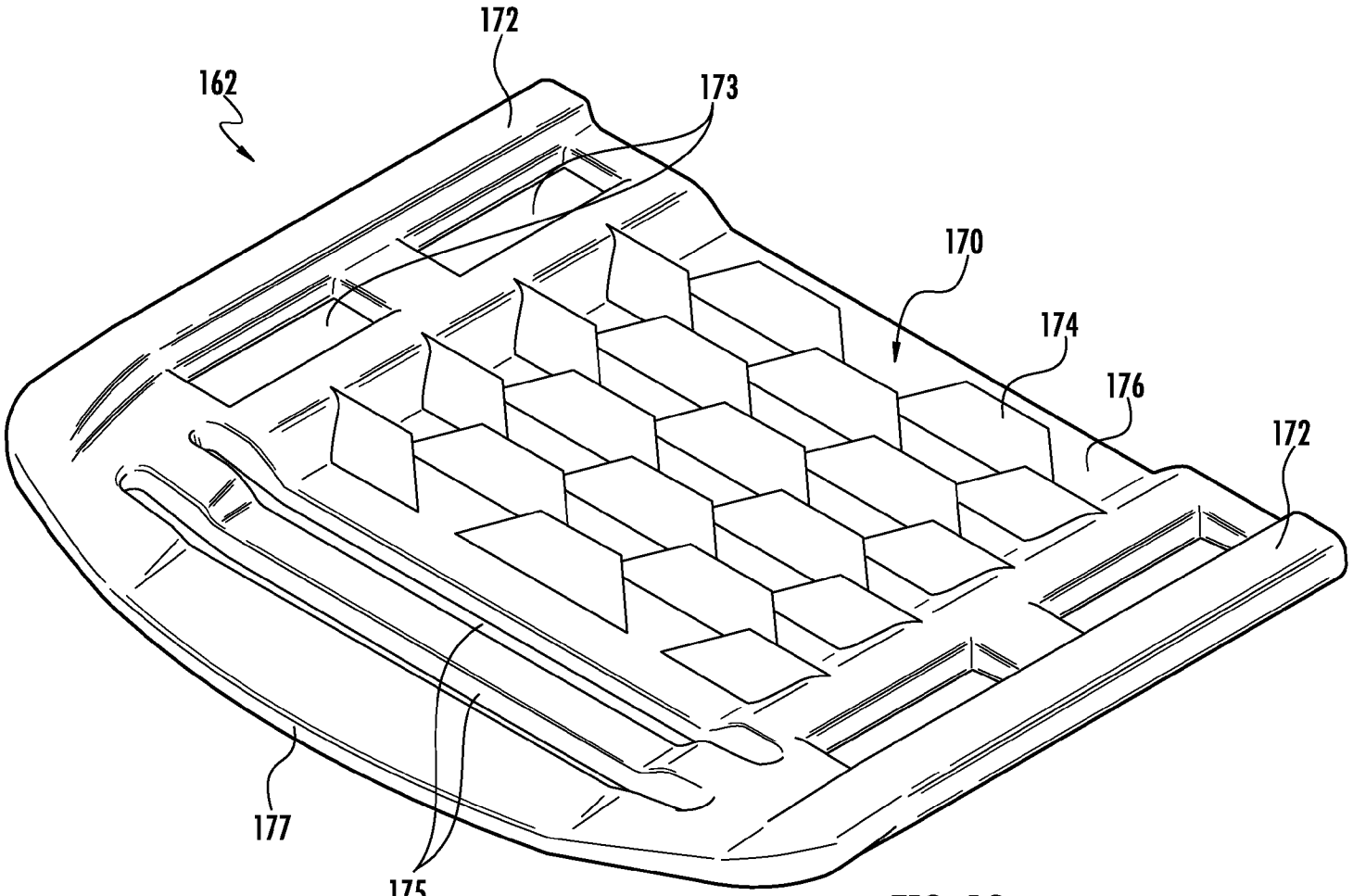
FIG. 12 shows a perspective view of a deformable component of the second fastening member of FIG. 11.

As best shown in FIG. 12, the deformable component 162 is generally rectangular in shape and includes a contoured interior surface 170 that is slightly recessed between two opposing side rails 172. The contoured surface 170 includes a flat portion 176 and an array of interlocking members in the form of teeth 174. The teeth 174 are wedge-shaped teeth with a trapezoidal footprint, like to the teeth 74 described above in the embodiment of FIG. 4, and are configured to engage the teeth 44 on the first fastening member 30.

Figure 11:
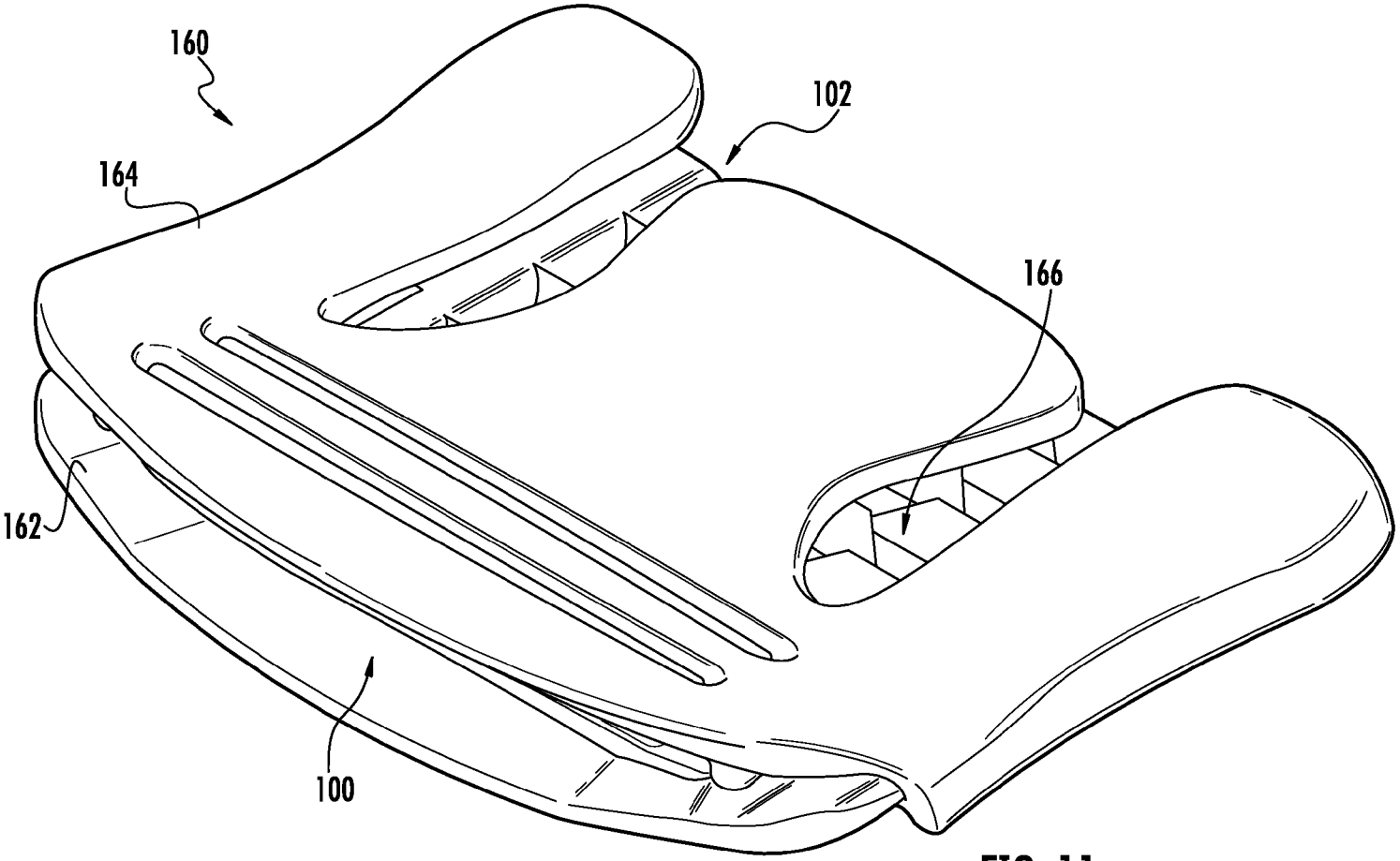
FIG. 11 shows a perspective view of a second embodiment of the second fastening member of FIG. 1.

In addition to the teeth 174, slots 175 are provided on a forward end of the contoured surface 170. The forward edge 177 of the contoured interior surface 170 is rounded and serves as a lip of a mouth 100 that leads to the channel 166 (as shown in FIG. 11).

With continued reference to FIG. 12, the opposing side rails 172 of the deformable component 162 are integral with the contoured interior surface 170 and flare slightly outward from the contoured interior surface 70. Two slots 173 are positioned adjacent to each side rail 172 and extend in a parallel direction to each side rail 172. The slots 173 are configured to receive arms 198 on the biasing member 164 that extend through the slots 173 and couple the biasing member 164 to the deformable component 162.

Figure 13:
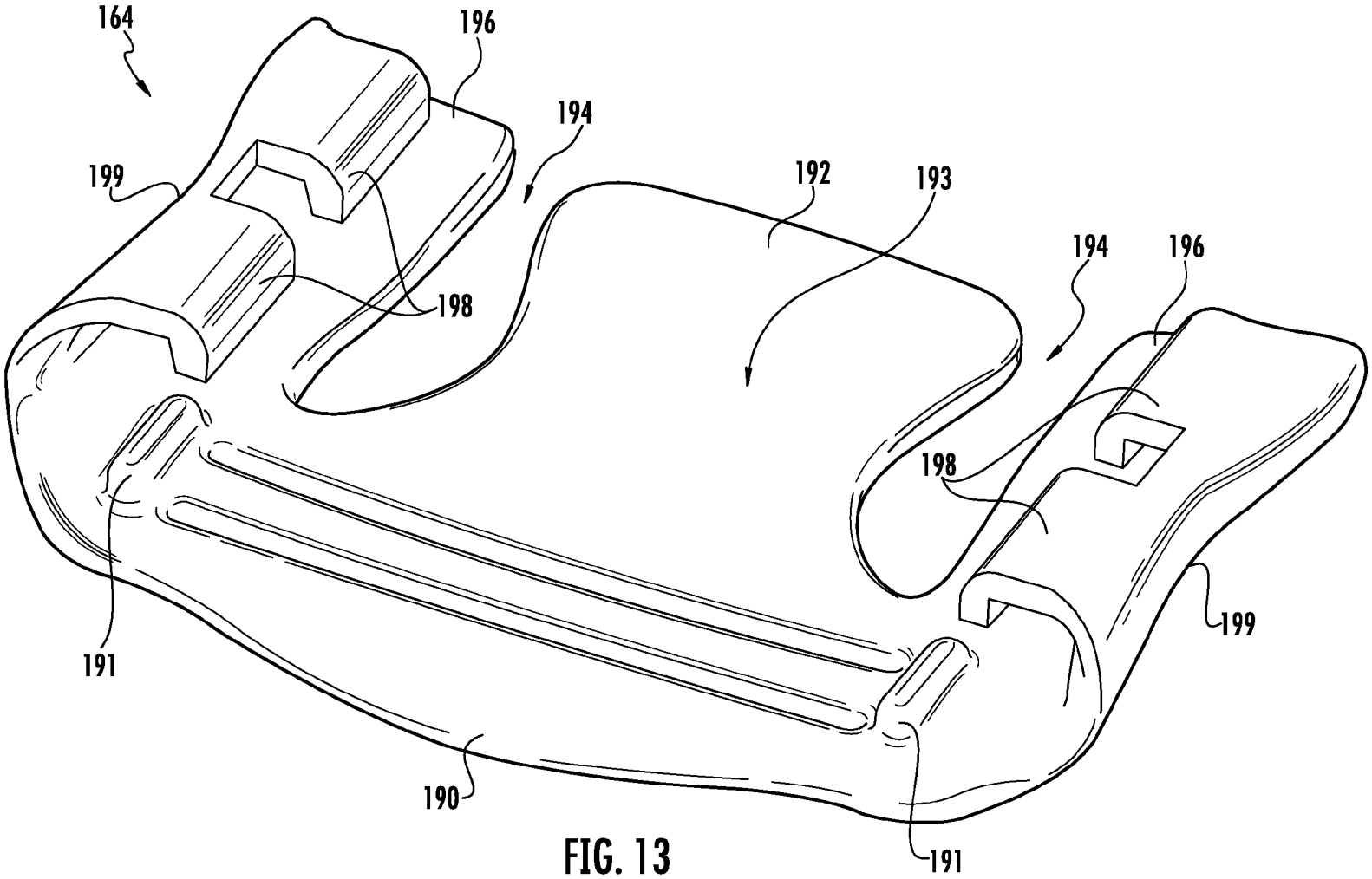
FIG. 13 shows a perspective view of a biasing member of the second fastening member of FIG. 11.

With reference now to FIG. 13, the biasing member 164 is generally W-shaped and includes a forward edge 190, detent features 191, a central bowed portion 192, rear recesses 194, two side arms 196, and four coupling arms 198. The forward edge 190 is slightly curved and flared and serves as a lip for the mouth 100 of the channel 166 (as shown in FIG. 11). The detent features 191 are protrusions that are provided on an inner surface of the biasing member 164 near the forward edge 190. These detent features are configured to keep the first fastening member 30 properly inline when the first fastening member 30 is inserted into the mouth 100 of the channel 166.

The central bowed portion 192 extends rearward from the forward edge 190 and between the rear recesses 194. The central bowed portion 192 includes a convex surface 193 that faces the channel 166 of the second fastening member 160. Each rear recess 194 extends between one of the side arms 196 and a side of the central bowed portion 192. When the biasing member 164 is coupled to the deformable component 162, these rear recesses 194 expose portions of the interior channel 166 of the second fastening member (as shown in FIG. 11).

Each side arm 196 provides a generally concave side surface 199 on the exterior of the second fastening member 160. These concave side surfaces 199 provide finger depressions on opposing sides of the second fastening member which are designed and dimensioned to easily engage a human fingertip. The rear recesses 194 allow the side arms 196 to flex inward toward the central bowed portion 192.

Figure 14:
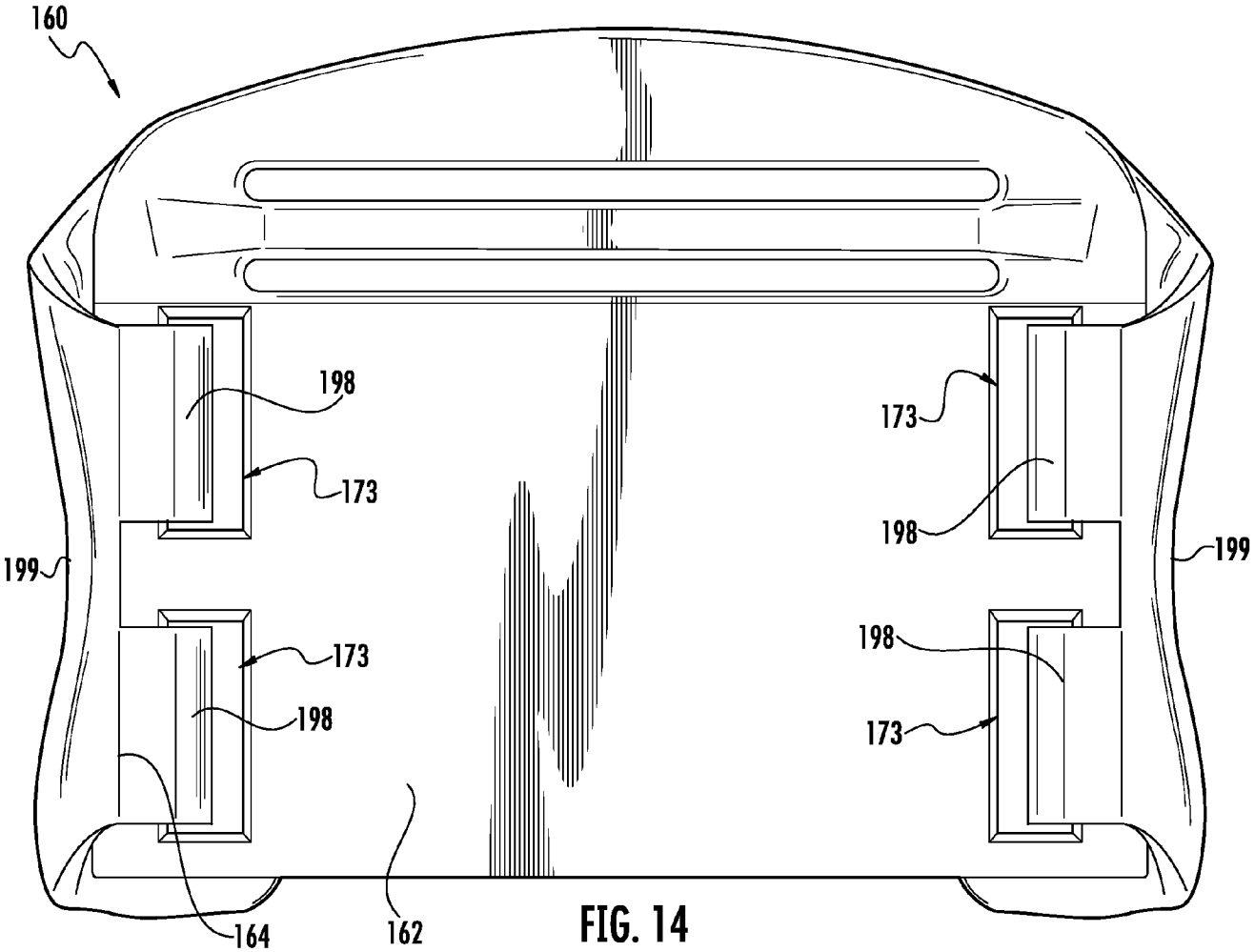
FIG. 14 shows a plan view of the second fastening member of FIG. 11 with the biasing member coupled to the deformable component.

With continued reference to FIG. 13, the four coupling arms 198 are integrally formed with the side arms 196 of the biasing member 164. The coupling arms 198 include hook-shaped members that are configured to extend through the slots 173 on the deformable component 162 and thereby couple the deformable component 162 to the biasing member 164. FIG. 14 shows the coupling arms 198 wrapping around the outside of the outer perimeter of the deformable component 162 and into the slots 173, thus coupling the deformable component 162 to the biasing member 164.

With reference again to FIG. 11, when the biasing member 164 is joined to the deformable component 162, the channel 166 is defined between the biasing member 164 and the deformable component 162. In particular, the channel 166 is formed by the contoured interior surface 170 of the deformable component 162, the side rails 172 of the deformable component 62, and the convex interior surface 193 on the central bowed portion 192 of the biasing member 164. The mouth 100 to the channel 66 is formed by the forward edge 177 of the deformable component 162 and the forward edge 190 of the biasing member 164. The height of the channel 166 is reduced near the middle of the channel as a result of the convex surface 193 of the biasing member 164. An exit 102 from the channel 166 is also provided via an opening at the rear of the second fastening member 160. The teeth 74 of the deformable component 162 extend inward toward the channel 166 and are inclined from the forward end (i.e. mouth 100) toward the rear end (i.e., exit 102) of the channel 166.

Figure 15:
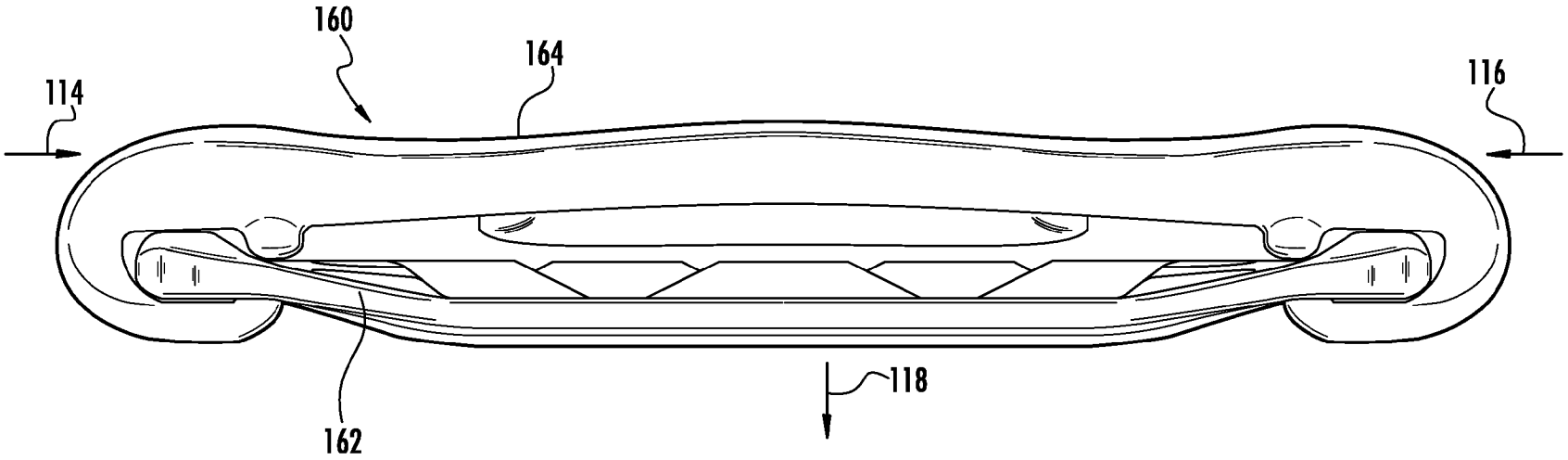
FIG. 15 shows a front view of the second fastening member of FIG. 11.

With reference now to FIG. 15, when a user wishes to release the first fastening member 30 from the channel 166 of the second fastening member 160, the user places his or her fingers on the finger depressions 199 at the sides of the biasing member 164. The user then presses inward on the finger depressions, providing opposing inward forces 114, 116 on the biasing member 164. This action causes the side arms 196 of the biasing member 164 to be moved inward in the direction of arrows 114, 116 toward the rear recesses 194 without significantly deforming the central bowed portion 192 of the biasing member 164. As the side arms 196 of the biasing member 164 are moved inward, they engage the sides of the deformable component 162, and force the sides inward, as indicated by arrows 114 and 116. These opposing inward forces 114, 116 result in deformation of the contoured interior surface 170 of the deformable component 162 in a release direction, indicated by arrow 118. In particular, the contoured interior surface 170 of the deformable component 162 bows outward, away from the biasing member 164, in response to the opposing inward forces 114, 116 being applied to the finger pads 86.

Movement of the contoured interior surface 170 in the release direction 118 opens the mouth 100 and moves the teeth 74 of the second fastening member 160 away from the teeth 44 of the first fastening member 30. With the mouth 100 open, and the teeth 74 disengaged from the teeth 44, the first fastening member 30 may be easily pulled out of the channel 166. After the first fastening member 30 is removed from the second fastening member 160, the user releases his or her fingers from the finger depressions 199, removing the opposing inward forces 114, 116 on the deformable component 162 and the biasing member 164. Because the deformable component 162 and the biasing member 164 are resilient, they return to their original non-deformed shape when the inward forces 114 and 116 are removed.

The foregoing detailed description of one or more embodiments of the fastening arrangement has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A fastening arrangement comprising:

a first fastening member including a first surface comprising an array of first interlocking members projecting from the first surface; and a second fastening member including a channel positioned between a second surface and a resilient biasing member, the channel configured to receive the first fastening member along an insertion direction with the first surface facing the second surface, the second surface comprising an array of second interlocking members projecting from the second surface, the second interlocking members configured to engage the array of first interlocking members in a manner that blocks the array of first interlocking members from moving relative to the array of second interlocking members in a direction perpendicular to the insertion direction, and the resilient biasing member configured to urge the array of first interlocking members into engagement with the array of second interlocking members when the first fastening member is inserted into the channel of the second fastening member.

2. The fastening arrangement of claim 1 wherein the array of first interlocking members comprises a plurality of first teeth arranged in rows and columns and the array of second interlocking members comprises a plurality of second teeth arranged in rows and columns.

3. The fastening arrangement of claim 2 wherein the first teeth have a trapezoidal footprint on the first surface and the second teeth have a trapezoidal footprint on the second surface.

4. The fastening arrangement of claim 3 wherein the second fastening member includes a mouth that leads to the channel, wherein the second teeth include a front side and a rear side with the front side closer to the mouth than the rear side, wherein the rear side of the second teeth are more elevated on the second surface than the front side, and wherein the first teeth include a first side and a second side, the second side including an edge that is more elevated on the first surface than the first side.

5. The fastening arrangement of claim 2 wherein the resilient biasing member is configured to successively urge the plurality of first teeth into engagement with the plurality of second teeth when the first fastening member is inserted into the second fastening member such that tactile feedback is provided during insertion of the first fastening member into the second fastening member.

6. The fastening arrangement of claim 1 wherein the second surface is comprised of a resilient material and wherein opposing pads are positioned on opposite sides of the second surface, the second surface configured to move away from the resilient biasing member when opposing inward forces are applied to the opposing pads, and wherein the second surface is configured to resiliently move toward the resilient biasing member and move the opposing pads away from one another when the opposing inward forces are removed from the opposing pads.

7. The fastening arrangement of claim 1 wherein the first fastening member and the second fastening member are comprised of a resilient plastic material.

8. The fastening arrangement of claim 1 wherein the second fastening member is substantially encased in fabric.

9. The fastening arrangement of claim 1 wherein the first fastening member includes a first face with the first surface provided on the first face and an opposing face with a substantially flat surface on the opposing face, wherein the substantially flat surface engages the resilient biasing member when the first fastening member is inserted into the second fastening member.

10. The fastening arrangement of claim 1 wherein the biasing member is provided by a leaf spring.

11. The fastening arrangement of claim 1 wherein the first fastening member is positioned on an end of a first strap and the second fastening member is positioned on an end of a second strap, wherein the fastening arrangement is configured to couple the end of the first strap to the end of the second strap when the first fastening member is inserted into the channel of the second fastening member.

12. The fastening arrangement of claim 11 wherein the first fastening member is molded on to the end of the first strap.

13. The fastening arrangement of claim 1 wherein the first fastening member and the second fastening member are positioned on a garment, a bag, a belt, a shoe, a pad, a glove or a watch.

14. The fastening arrangement of claim 1 wherein the first fastening member is configured to be adjustably received by the second fastening member such that the array of first interlocking members further engage the array of second interlocking members as the first interlocking member is inserted further into the channel of the second interlocking member.

15. A fastening arrangement comprising:

first fastening member including a first surface comprising an array of first teeth projecting from the first surface, the array of first teeth including a first plurality of first teeth aligned along an insertion direction and second plurality of first teeth aligned along a direction perpendicular to the insertion direction; and a second fastening member including a channel positioned between a second surface and a resilient biasing member, the channel configured to receive the first fastening member along the insertion direction with the first surface facing the second surface, the second surface comprising an array of second teeth projecting from the second surface, the second teeth including a first plurality of second teeth aligned along the insertion direction and second plurality of second teeth aligned along the direction perpendicular to the insertion direction, and the resilient biasing member configured to urge the array of first teeth into engagement with the array of second teeth when the first fastening member is inserted into the channel of the second fastening member.

16. The fastening arrangement of claim 15 wherein the channel is further defined by a mouth at one end of the channel, wherein the biasing member is configured to urge the first surface into engagement with the second surface when a release force is not applied to the second surface, and wherein the mouth is more open when the release force is applied to the second surface than when the release force is not applied to the second surface.

17. The fastening arrangement of claim 16 wherein the second surface is substantially planar when not deformed by the release force.

18. The fastening arrangement of claim 17 wherein the second fastening member includes a first finger pad on one side of the second fastening member and a second finger pad on an opposite side of the second fastening member, wherein the release force results when a first force is applied in one direction to the first finger pad and a second force is applied in an opposite direction on the second finger pad.

19. A method of fastening and releasing two members comprising inserting a first fastening member into a channel of a second fastening member in an insertion direction;

urging an array of first interlocking members on a first surface of the first fastening member into engagement with an array of second fastening members on a second surface within the channel of the second fastening member;

sliding the array of first interlocking members over the array of second interlocking members as the first fastening member is moved further into the channel in the insertion direction;

abutting the first interlocking members with the second interlocking members within the channel such that the first interlocking members are blocked from moving relative to the second interlocking members in a removal direction that is opposite the insertion direction and the first interlocking members are blocked from moving relative to the second interlocking members in a direction perpendicular to the insertion direction;

deforming the second surface such that the second interlocking members are removed from the first interlocking members; and releasing the first fastening member from the second fastening member by moving the first fastening member out of the channel in the removal direction.

* * * * *